US012486083B2

(12) United States Patent
Fabien

(10) Patent No.: US 12,486,083 B2
(45) Date of Patent: Dec. 2, 2025

(54) DEVICE FOR SEALING A FLUID PRODUCT VESSEL

(71) Applicant: APTAR FRANCE SAS, Le Neubourg (FR)

(72) Inventor: David Fabien, Saint Renan (FR)

(73) Assignee: APTAR FRANCE SAS, Le Neubourg (FR)

( * ) Notice: Subject to any disclaimer, the term of this patent is extended or adjusted under 35 U.S.C. 154(b) by 161 days.

(21) Appl. No.: 18/278,475

(22) PCT Filed: Feb. 22, 2022

(86) PCT No.: PCT/FR2022/050320

§ 371 (c)(1),
(2) Date: Aug. 23, 2023

(87) PCT Pub. No.: WO2022/180337

PCT Pub. Date: Sep. 1, 2022

(65) Prior Publication Data

US 2024/0132257 A1 Apr. 25, 2024
US 2024/0228125 A9 Jul. 11, 2024

(30) Foreign Application Priority Data

Feb. 24, 2021 (FR) ..... 2101797

(51) Int. Cl.
*B65D 41/58* (2006.01)
*B65D 45/30* (2006.01)
(Continued)

(52) U.S. Cl.
CPC ..... *B65D 41/58* (2013.01); *B65D 45/30* (2013.01); *B65D 51/002* (2013.01); *B65D 55/06* (2013.01); *B65D 2401/15* (2020.05)

(58) Field of Classification Search
CPC ..... B65D 51/002; B65D 2401/15; B65D 2401/00; B65D 2401/25; B65D 51/18;
(Continued)

(56) References Cited

U.S. PATENT DOCUMENTS 2,444,779 A * 7/1948 Krasberg ..... B65D 45/322 220/233
2,734,649 A * 2/1956 Callahan et al. .. B65D 55/0845 215/233
(Continued)

FOREIGN PATENT DOCUMENTS

DE 102017127313 A1 5/2019
WO 2017/001459 A1 1/2017

OTHER PUBLICATIONS

International Search Report for PCT/FR2022/050320 dated Apr. 28, 2022.
(Continued)

*Primary Examiner* — Steven A. Reynolds
*Assistant Examiner* — Prince Pal
(74) *Attorney, Agent, or Firm* — Sughrue Mion, PLLC

(57) ABSTRACT

A device for sealing a vessel, having a stopper for closing the vessel, the stopper including a sealing mechanism for sealing with the vessel; an attachment ring for attaching the stopper to the vessel, the ring has a sleeve provided with a radial flange with a central opening, and first attachment mechanism to be attached to the vessel; a cover having a radial disc and second attachment mechanism; a blocking element having an axial wall and a complementary attachment mechanism engaging in the assembled state with the second attachment mechanism. The axial wall has on one portion of its periphery a tearable tab defined between two grooves forming bridges of thin material, the tab having, on one side, a gripping portion and ending, on the opposite side, with a flared portion such that, once torn, the axial wall
(Continued)

Figure 1:
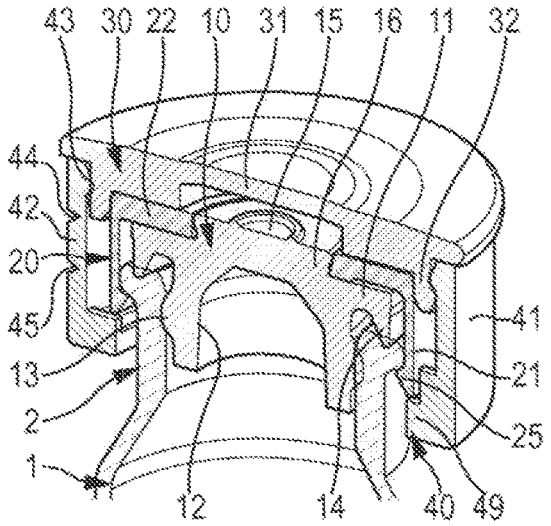

opens out along the entire height allowing removal of the blocking element.

14 Claims, 3 Drawing Sheets

(51) Int. Cl.
*B65D 51/00* (2006.01)
*B65D 55/06* (2006.01)

(58) Field of Classification Search
CPC ..... B65D 41/28; B65D 41/00; B65D 41/02; B65D 41/30; B65D 41/005; B65D 41/58; B65D 41/32; B65D 45/30; A61J 1/1412; A61J 1/1425
USPC ..... 215/249, 274, 277, 254, 296, 247, 272, 215/256; 220/315
See application file for complete search history.

(56) References Cited

U.S. PATENT DOCUMENTS 2,950,834 A * 8/1960 Mazza ..... B65D 45/02 215/254
3,109,547 A * 11/1963 Wood ..... B65D 41/485 215/256
3,109,548 A * 11/1963 Wood ..... B65D 41/485 215/354
3,338,446 A * 8/1967 Faulstich ..... B65D 41/485 215/256
3,792,794 A * 2/1974 Cutter ..... B65D 51/002 215/256
3,913,772 A * 10/1975 Ochs ..... B65D 41/3404 215/256
3,946,891 A * 3/1976 Picoy ..... B65D 41/58 215/256
4,032,029 A * 6/1977 Cochrane ..... B65D 41/485 215/256
4,037,746 A * 7/1977 Ver Hage ..... B65D 41/485 215/256
4,149,647 A * 4/1979 Ritzenhoff ..... B65D 41/40 215/254
4,166,552 A * 9/1979 Faulstich ..... B65D 41/485 215/901
4,251,003 A * 2/1981 Bodenmann ..... B65D 55/02 215/254
4,471,879 A * 9/1984 Connor ..... B65D 51/002 215/249
4,474,302 A * 10/1984 Goldberg ..... B65D 41/48 215/256
4,506,797 A * 3/1985 Bullock, III ..... B65D 41/62 215/256
4,553,679 A * 11/1985 Hatakeyama ..... B29C 45/1418 215/232
4,567,992 A * 2/1986 Davis ..... B65D 41/36 215/256
4,749,096 A * 6/1988 Thomas ..... B65D 41/62 53/88
4,784,279 A * 11/1988 Osting ..... B65D 55/0845 215/254
5,052,574 A * 10/1991 McKinnon ..... B65D 43/0212 220/276
5,085,332 A * 2/1992 Gettig ..... B65D 55/0872 215/277
5,269,429 A * 12/1993 Schumacher ..... B65D 55/0872 215/256
5,314,084 A * 5/1994 Folta ..... B65D 51/241 215/350
5,373,954 A * 12/1994 Julian ..... B65D 41/3409 215/256
8,556,096 B2 * 10/2013 Parmaningsih ..... B29C 45/16 215/256
8,590,749 B2 * 11/2013 Beranger ..... B05B 11/1049 222/320
8,684,225 B2 * 4/2014 Gelibert ..... B65D 51/002 215/277
8,777,031 B2 * 7/2014 Aneas ..... B65D 51/241 215/277
8,839,971 B2 * 9/2014 Aneas ..... B65D 51/241 215/350
9,555,941 B2 * 1/2017 Ogawa ..... A61J 1/1425
10,144,560 B2 * 12/2018 Mutterle ..... B65D 51/002
10,843,913 B2 * 11/2020 Mutterle ..... B65D 45/322
11,535,429 B2 * 12/2022 Clavel ..... B65D 1/023
11,738,915 B2 * 8/2023 Clavel ..... B65D 81/18 215/40
12,115,127 B2 * 10/2024 Yano ..... B65D 51/20
12,187,497 B2 * 1/2025 Bisio ..... B65D 41/28
2005/0067366 A1 * 3/2005 Dubach ..... B29C 45/44 220/837
2005/0086830 A1 * 4/2005 Zukor ..... B01L 3/50825 34/443
2010/0012615 A1 * 1/2010 Brooks ..... B65D 41/62 215/256
2010/0050575 A1 * 3/2010 Aneas ..... B65D 51/002 53/485
2010/0224632 A1 * 9/2010 Aneas ..... B65D 51/002 220/315
2011/0266249 A1 * 11/2011 Kakutani ..... B65D 51/002 215/296
2012/0160850 A1 * 6/2012 Gelibert ..... B65D 55/063 220/315
2012/0187072 A1 * 7/2012 Belle ..... B65D 45/32 215/274
2013/0233822 A1 * 9/2013 Aneas ..... B65D 41/28 215/320
2014/0217099 A1 * 8/2014 Browne ..... A61J 1/1412 220/259.5
2015/0013811 A1 * 1/2015 Carrel ..... A61J 1/1425 137/798
2015/0013837 A1 * 1/2015 Barrelle ..... A61J 1/201 141/330
2015/0014316 A1 * 1/2015 Chanas ..... B65D 51/002 215/274
2016/0194121 A1 * 7/2016 Ogawa ..... A61J 1/05 215/249
2016/0200488 A1 * 7/2016 Friedrich ..... B65D 41/44 215/253
2017/0121163 A1 * 5/2017 Mutterle ..... B65D 39/0052
2017/0316302 A1 * 11/2017 Clere ..... B65D 39/0052
2018/0134457 A1 * 5/2018 Mutterle ..... B65D 41/62
2018/0141729 A1 * 5/2018 Mutterle ..... B65D 51/2807
2020/0122906 A1 * 4/2020 Thomas ..... B65D 51/28
2021/0009319 A1 * 1/2021 Clavel ..... B65D 1/023
2021/0009320 A1 * 1/2021 Clavel ..... A61J 1/14
2022/0241149 A1 * 8/2022 Yano ..... A61J 1/1431
2022/0339067 A1 * 10/2022 Christie ..... B65B 7/2821
2022/0411161 A1 * 12/2022 Morris, III ..... B65D 81/2038
2023/0036805 A1 * 2/2023 Rey ..... B67C 7/00
2023/0414451 A1 * 12/2023 Yoshida ..... A61J 1/1425
2024/0000660 A1 * 1/2024 Yoshida ..... A61J 1/1425
2024/0033180 A1 * 2/2024 Yoshida ..... A61J 1/1406
2024/0051719 A1 * 2/2024 Cavusoglu Ataman ..... A61J 1/1412
2024/0067412 A1 * 2/2024 Bisio ..... B65D 41/28
2024/0132257 A1 * 4/2024 Fabien ..... B65D 51/18
2025/0017819 A1 * 1/2025 Kellner ..... A61J 1/1425

OTHER PUBLICATIONS

Written Opinion for PCT/FR2022/050320 dated Apr. 28, 2022.
International Preliminary Report on Patentability with Translation of Written Opinion issued Aug. 29, 2023 in Application No. PCT/FR2022/050320.

* cited by examiner

DEVICE FOR SEALING A FLUID PRODUCT VESSEL

CROSS REFERENCE TO RELATED APPLICATIONS

This application is a National Stage of International Application No. PCT/FR2022/050320 filed Feb. 22, 2022, claiming priority based on French Patent Application No. FR2101797 filed Feb. 24, 2021.

The present invention relates to a device for sealing a fluid product vessel, for example a vial containing a pharmaceutical fluid product. A favoured field of application of the present invention is that of stoppers being able to be pierced using a needle to sample all or some of the fluid product contained in the vessel.

Generally, a sealing device of this type comprises a stopper made of relatively flexible material, such as an elastomer, which is inserted with force in the collar of the vessel. During assembly, the stopper is pushed into its closing position, wherein it sealingly seals the vessel, and a metal capsule is mounted, in particular crimped, around the stopper to attach it to the collar of the vessel.

This known implementation involves several disadvantages.

Thus, if the capsule is not pierced to enable the piercing of the stopper to sample the fluid contained in the vessel, this capsule must be completely removed before use, which can be difficult. This also involves a risk of accidental removal of the stopper, with, due to this, a risk of loss of the fluid contained in the vessel.

On the other hand, if the capsule is pierced to enable a piercing of the stopper, this portion not covered by the capsule is not protected, in particular during transport and storage, consequently with a risk for the integrity of the fluid contained in the vessel. In this case, it is almost impossible to know if the stopper has already been pierced or not, consequently with an uncertainty about the content of the vessel.

Moreover, the use of a metal capsule, generally made of aluminium, can generate metal particles during the crimping of the capsule on the collar of the vessel, which is potentially damaging for the fluid contained in the vessel. More generally, the use of metal part is disadvantageous in terms of recycling and respecting the environment.

To overcome these disadvantages, it has been proposed to use a plastic attachment ring to attach and hold the stopper on the vessel, with a blocking element assembled around the ring to hold its attachment, and a cover removably disposed on the ring or on the blocking element, to protect the stopper until using the device. Document WO2017001459 describes a device of this type.

Devices of this type also have disadvantages.

Thus, the removable protective cover can generally be removed and put back in place easily, such that it is impossible to know if the product has already been sampled or not from the vessel. The integrity of the fluid contained in the vessel is not guaranteed, either.

In addition, the complexity of this type of sealing device does not enable an assembly at high rates, by using, for example, a machine which could simultaneously assemble several tens of sealing devices.

Document DE102017127313 describes another prior-art device.

The present invention aims to overcome the abovementioned disadvantages.

The present invention in particular aims to provide a sealing device which guarantees the integrity of the fluid contained in the vessel until its use.

The present invention also aims to provide a sealing device which comprises a tamper-proof first use indicator.

The present invention also aims to provide a sealing device which makes it possible to use a stopper provided with a coating on the face in contact with the fluid product.

The present invention also aims to provide a sealing device which has no metal at all.

The present invention also aims to provide a sealing device which can be assembled at high rates, in particular in an assembly machine which could assemble several tens, for example one hundred, devices simultaneously.

The present invention also aims to provide a sealing device which is simple and inexpensive to manufacture and to assemble.

The present invention therefore aims for a device for sealing a fluid product vessel comprising a collar provided with an upper axial edge, said sealing device comprising:

- a stopper comprising a radial plate and an axial drum, said axial drum penetrating inside said collar during assembly, said stopper comprising sealing means for sealing with said vessel,
- an attachment ring for attaching said stopper to said collar, said attachment ring comprising a cylindrical axial sleeve provided on the upper side with a radial flange extending radially inwards and comprising a central opening, said cylindrical axial sleeve comprising, on the lower side, first attachment means for being attached to said collar of said vessel,
- a cover comprising a radial disc and a cylindrical axial envelope extending axially downwards from said radial disc, said cover comprising second attachment means,
- a blocking element comprising a cylindrical axial wall and complementary attachment means engaging in the assembled state with said second attachment means of said cover,
- said axial wall comprising on one portion of its periphery, a tearable tab defined between two grooves forming bridges of thin material, said tab comprising, on one side, a gripping portion and ending on the opposite side with a flared portion, such that, once torn, said axial wall opens out all along its entire height, thus making it possible to remove said blocking element from said sealing device.

Advantageously, said axial drum of said stopper comprises, on its outer surface, at least one sealing bead which engages with the inside of said collar of said vessel to guarantee the sealed sealing of said vessel.

Advantageously, said radial plate of said stopper has an external diameter greater than the external diameter of said axial drum, and comprises at least one annular projection extending downwards which, in the sealing position, engages with said upper axial edge of said collar.

Advantageously, said annular projection is peripheral and is, during the assembly of said sealing device on said collar of said vessel, flattened on said upper axial edge of said collar for sealing with said vessel.

Advantageously, said radial plate comprises a central tapping zone defined inside an axial ring.

Advantageously, the radially external edge of said axial ring is conic by flaring upwards.

Advantageously, in the assembled state of said sealing device, said radial flange of said attachment ring is positioned on said radial plate of said stopper, said central opening receiving said axial ring and said tapping zone of said stopper.

Advantageously, the radial edge of said central opening is snap-fitted on said radially external conic edge of said axial ring.

Advantageously, said first attachment means of said attachment ring are snap-fitting means, comprising at least one radial profile extending radially inwards.

Advantageously, said first attachment means comprise one single radial profile which extends over the entire periphery of said cylindrical axial sleeve.

Advantageously, the internal diameter of said axial envelope of said cover is identical or very slightly greater than the external diameter of said axial sleeve of said attachment ring, such that in the assembled state of the sealing device, said axial envelope is positioned around said axial sleeve with no or little clearance between them.

Advantageously, said second attachment means of said cover comprise one or more projection(s) extending radially outwards.

Advantageously, said complementary attachment means of said blocking element comprise one or more profiles extending radially inwards, said profiles being snap-fitted on said one or more projection(s) forming said second attachment means of said cover.

Advantageously, said axial wall of said blocking element comprises, on its lower axial edge, an annular radial wall extending radially inwards, the radially internal edge of said annular radial wall having a diameter less than the external diameter of said cylindrical axial sleeve of said attachment ring, and less than the external diameter of said vessel.

Advantageously, said device has no metal.

The present invention also aims for an assembly comprising a fluid product vessel comprising a collar and a sealing device such as described above, to attach and hold a stopper on said collar.

Figure 2:
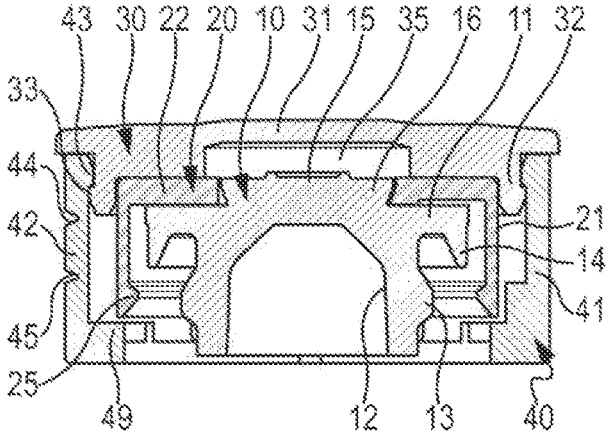
Figure 3:
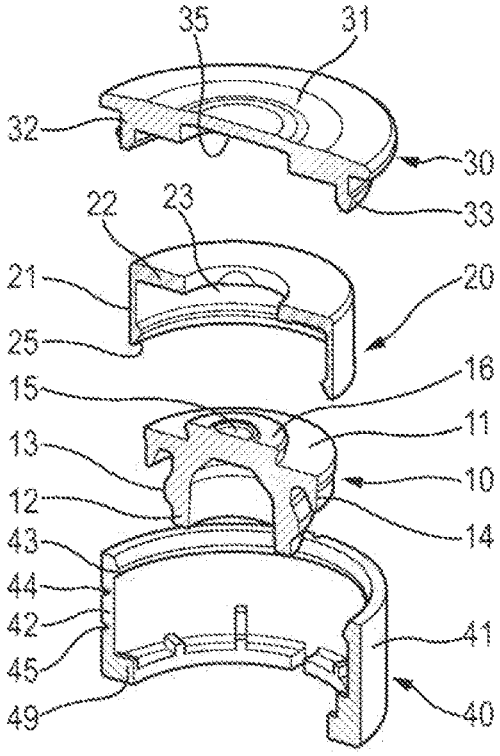
Figure 4:
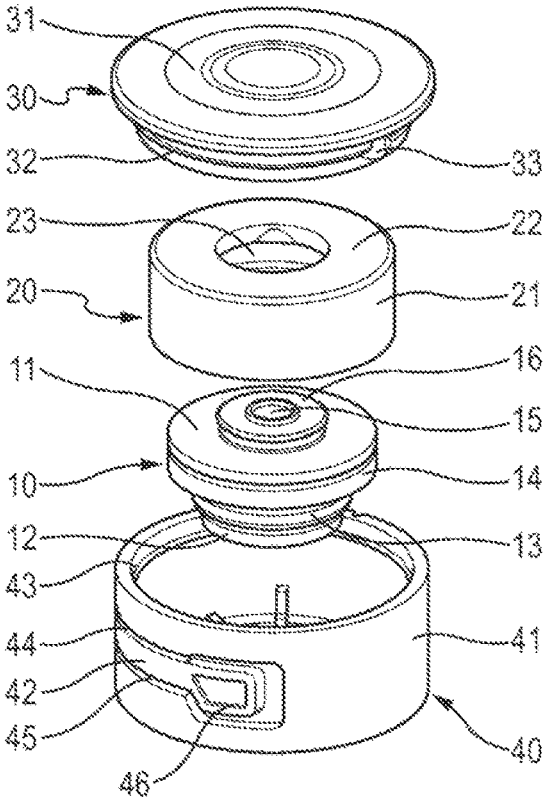
Figure 5:
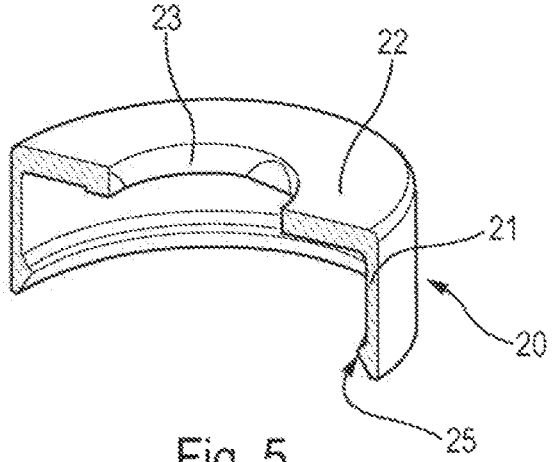
Figure 6:
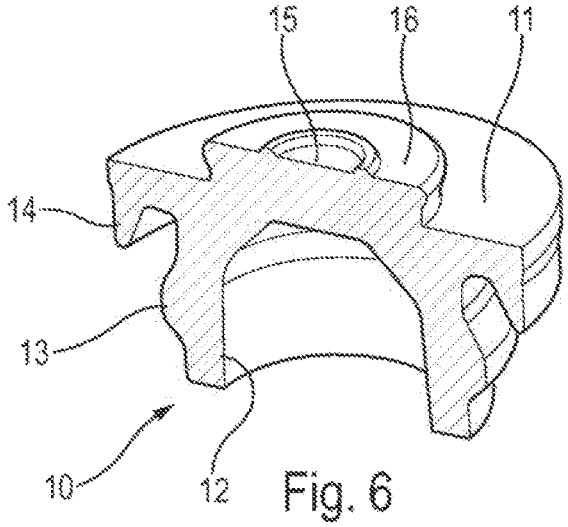
Figure 7:
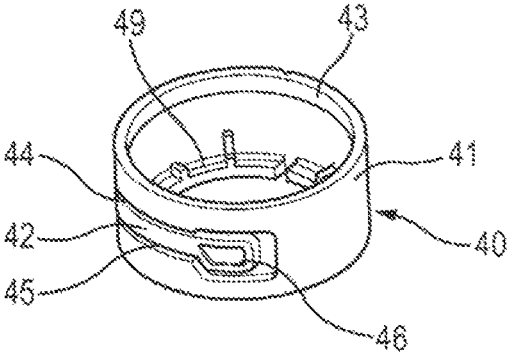
Figure 8:
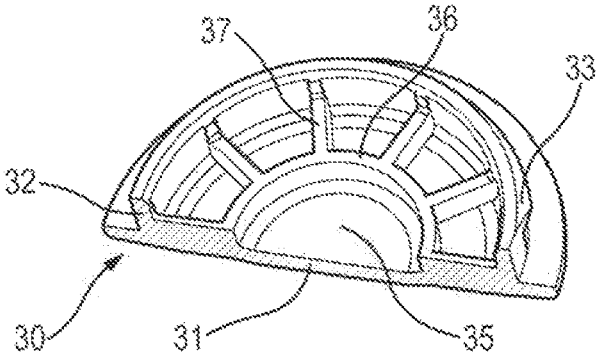
Figure 9:
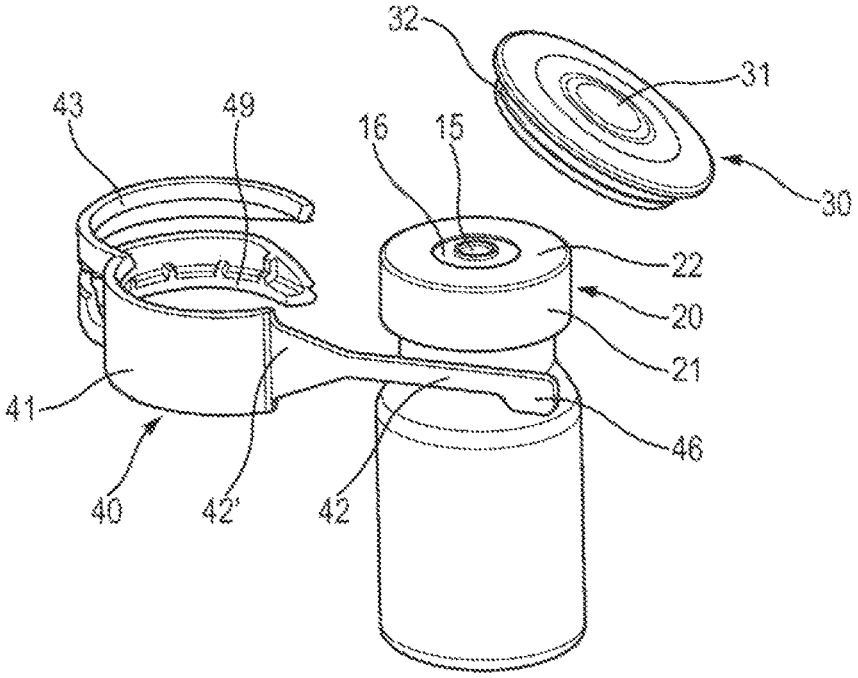
Figure 10:
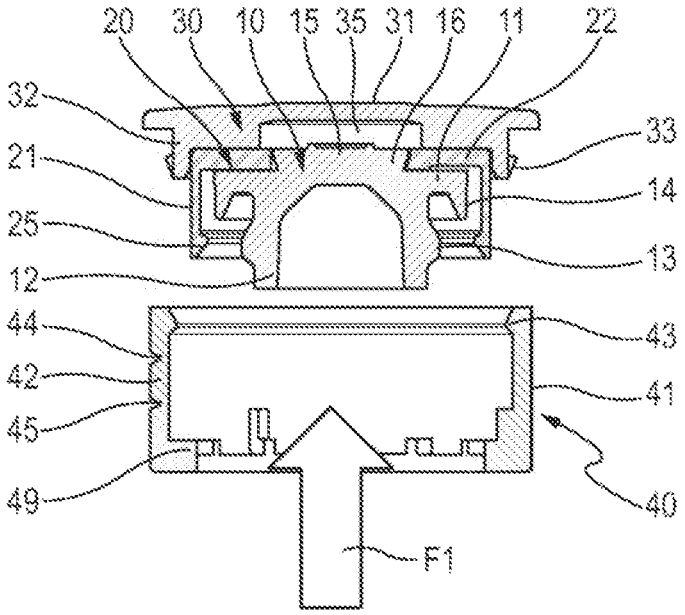
Figure 11:
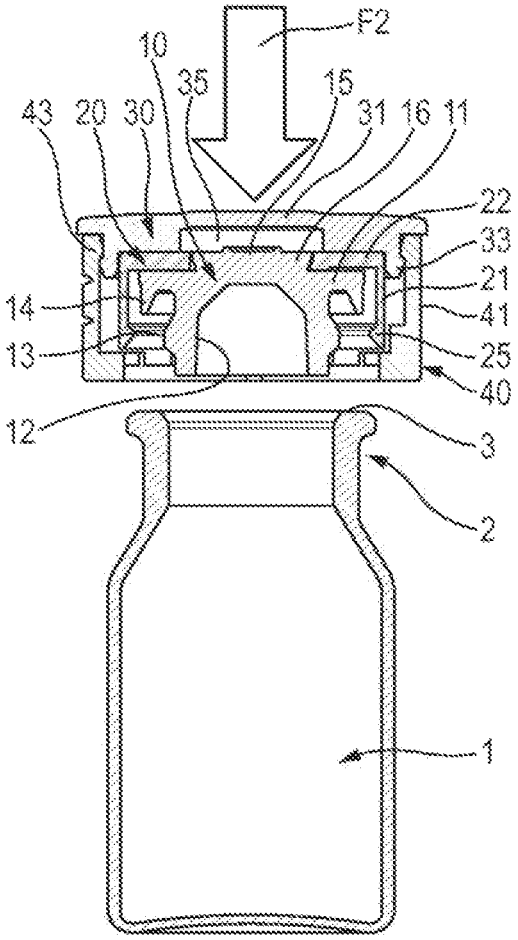
Figure 12:
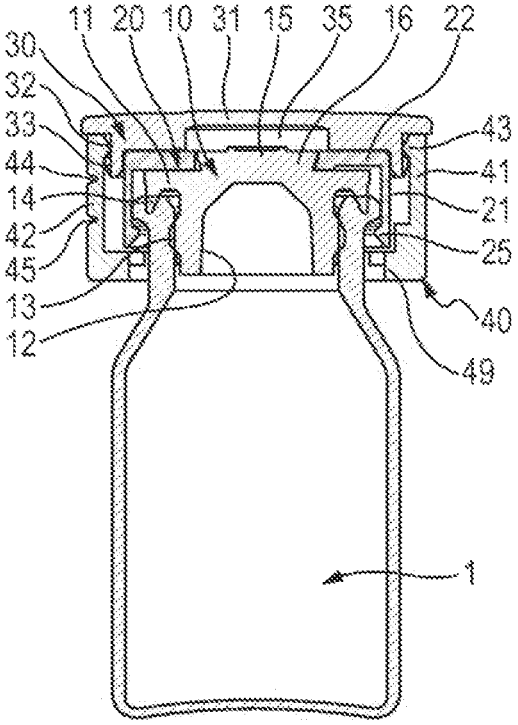

These features and advantages and others of the present invention will appear more clearly during the following detailed description, made in reference to the accompanying drawings, given as non-limiting examples, and wherein:

FIG. 1 is a schematic, perspective, cross-sectional view of a sealing device attached to a vessel, according to an advantageous embodiment, FIG. 2 is a schematic, vertical cross-sectional view of the sealing device of FIG. 1, FIG. 3 is a schematic, perspective, cross-sectional and exploded view of the sealing device of FIG. 2, FIG. 4 is a view similar to that of FIG. 3, in an exploded perspective, FIG. 5 is a schematic, perspective, cross-sectional view of the attachment ring of the sealing device of FIG. 2, FIG. 6 is a schematic, perspective, cross-sectional view of the stopper of the sealing device of FIG. 2, FIG. 7 is a schematic, perspective view of the blocking element of the sealing device of FIG. 2, FIG. 8 is a schematic, perspective, cross-sectional bottom view of the cover of the sealing device of FIG. 2, FIG. 9 is a schematic, perspective, exploded view of the sealing device of FIG. 1, after removal of the blocking element and of the cover, FIG. 10 is a schematic, vertical cross-sectional view of the sealing device of FIG. 2 during assembly, according to an advantageous variant embodiment, and FIGS. 11 and 12 are schematic, vertical cross-sectional views of the sealing device of FIG. 2, respectively before and after assembly on a vessel.

The terms "axial" and "radial" are relative to the longitudinal central axis of the device. The terms "top", "bottom", "upper" and "lower" refer to the upright position of the device represented in FIGS. 11 and 12.

A vessel 1, which can be made of plastic or of glass, is formed with a collar 2 at its upper portion. The vessel 1 can, in particular, be presented in the form of a vial. The vessel 1 contains a fluid product, in particular, of the pharmaceutical type.

According to the invention, a sealing device is attached to the collar 2 of the vessel 1. This sealing device comprises a stopper 10, an attachment ring 20, a cover 30 and a blocking element 40.

The stopper 10 provided to sealingly seal the vessel 1 is preferably made of elastically deformable material, like for example, rubber or any other suitable elastomer material.

This stopper 10 comprises a radial plate 11 and a roughly cylindrical axial drum 12. In the sealing position, the axial drum 12 penetrates inside said collar 2.

The stopper 10 comprises sealing means for sealing with the vessel.

According to a first advantageous variant of the sealing means, the axial drum 12 comprises on its outer surface, at least one peripheral sealing bead 13 which engages with the inside of the collar 2 of the vessel 1 to guarantee the sealed sealing of the vessel.

Advantageously, the radial plate 11 has an external diameter greater than the external diameter of the axial drum 12, and comprises at its radially outer edge, an annular projection 14 extending downwards. During the assembly of the sealing device on the vessel, this annular projection 14 will be deformed and ensure a certain spring effect, as well as a dimensional compensation, to optimise the assembly and/or the sealing in the assembled state.

According to a second advantageous variant of the sealing means, the annular projection 14 is peripheral and is, during the assembly of the sealing device on the collar 2 of the vessel 1, flattened on the upper axial edge 3 of said collar 2 to seal with the vessel 1. In this variant, the sealing bead 13 is no longer compulsory, and could either be completely omitted, or replaced by several bead portions separated from one another and distributed over the periphery of the axial drum 12, without a sealing function.

The radial plate 11 comprises a tapping zone 15 intended to be pierced by a suitable device, such as a syringe, to sample all or some of the fluid product contained in the vessel 1. This tapping zone 15 is preferably central and defined inside the axial ring 16, as can be seen, in particular, in FIG. 6. Advantageously, the radially external edge of said axial ring 16 is slightly conic by flaring upwards.

Optionally, the internal surface of the stopper 10 which comes into contact with the fluid product contained in the vessel 1 can be covered with a coating, in particular a thin ETFE (ethylene tetrafluoroethylene) film, in order to limit the interactions between the stopper 10 and the fluid product.

The attachment ring 20 is provided to attach and hold the stopper 10 on the collar 2 of the vessel 1.

This attachment ring 20 comprises a cylindrical axial sleeve 21 provided on the upper side with a radial flange 22 extending radially inwards and comprising a central opening 23. In the assembled position of the sealing device, which can be seen, in particular, in FIGS. 1 and 2, said radial flange 22 is positioned on the radial plate 11 of the stopper 10, with the opening 23 receiving the axial ring 16 and the tapping zone 15 of the stopper 10. Advantageously, the radial edge of said central opening 23 is snap-fitted on the radially external edge of said axial ring 16 when it is slightly conic.

On its lower side, the cylindrical axial sleeve 21 comprises first attachment means 25, in particular by snap-fitting, to be attached to the collar 2 of the vessel 1. These first attachment means 25 comprise a radial profile extending radially inwards. In the example represented, this radial profile is peripheral, but it could, in a variant, comprise several lugs distributed over the periphery. Other attachment means on the collar 2 of the vessel 1 can also be considered.

The cover 30 comprises a radial disc 31 which, in the assembled state, is positioned on the upper surface of the radial flange 22 of the attachment ring 20, as can be seen, in particular, in FIGS. 1 and 2.

The cover 30 also comprises a cylindrical axial envelope 32 extending axially downwards from said radial disc 31, the internal diameter of said axial envelope 32 being identical to or very slightly greater than the external diameter of the axial sleeve 21 of the attachment ring 20. Thus, in the assembled state, said axial envelope 32 is positioned around the axial sleeve 21 with no or little clearance between them.

Advantageously, as can be seen in the figures, the axial envelope 32 only extends over a small portion of the height of the axial sleeve 21.

The axial envelope 32 comprises second attachment means 33, such as one or more projection(s) extending radially outwards, which will be described in more detail below. These second attachment means 33 are advantageously provided at the lower axial edge of the axial envelope 32.

Advantageously, as can be seen in FIG. 8, the lower surface of the radial disc 31 comprises a central recess 35 delimited by an annular axial projection 36, said central recess 35 being in the assembled state above the tapping zone 15 of the stopper 10. In the example represented in FIG. 8, the annular axial projection 36 is connected to the axial envelope 32 by a plurality of radial bridges 37 distributed around the periphery. In this implementation, these are therefore the annular axial projection 36 and the radial bridges 37 which are, in the assembled state, in contact with the upper surface of the radial flange 22 of the attachment ring 20.

The blocking element 40 comprises a cylindrical axial wall 41, the internal diameter of which is greater than the external diameter of the axial envelope 32 and that of the second attachment means 33 of the cover 30.

The axial wall 41 comprises complementary attachment means 43, advantageously at its upper axial edge. In the example represented in the figures, these complementary attachment means comprise one or more profiles 43 extending radially inwards, with the internal diameter of said profiles 43 which is identical to or slightly greater than the external diameter of the axial envelope 32, but less than the external diameter of the projections 33 of the cover 30. Thus, in the assembled state, the profiles 43 of the blocking element 40 are snap-fitted on the projection(s) 33 of the cover 30. To optimise this snap-fitting, the outer shape of the profiles 43 and projections 33 can be achieved conventionally, with inclined planes sliding over one another during the assembly phase, and radial surfaces forming snap-fitting abutments after assembly.

In the example represented in the figures, the cover 30 comprises several separate projections 33, for example two or three, distributed over the periphery, but only one projection 33 extending radially outwards over the entire periphery could also be considered. Similarly, in the example represented in the figures, the blocking element 40 comprises one single profile 43 extending radially inwards over the entire periphery, but several separate profiles 43 distributed over the periphery could also be considered.

In a variant, the second attachment means 33 of the cover 30 and the complementary attachment means 43 of the blocking element 40 could be achieved differently, without necessarily forming a snap-fitting. Thus, it is possible to attach the cover 30 to the blocking element 40 non-removably, for example by laser or ultrasonic welding. In this variant, the cover 30 and the blocking element 40 thus form a single subassembly. Other alternative attachments are also possible.

The axial wall 41 comprises over one portion of its periphery, a tearable tab 42 defined between two grooves 44, 45 which form bridges of thin material. This tab 42 comprises a gripping portion 46 that the user can hold to tear the tab over a portion of the periphery of the blocking element 40. As can be seen in FIG. 9, the tearable tab 42 ends on the side opposite the gripping portion 46 by a flared portion 42', such that once torn, the axial wall 41 opens out all along its entire height, thus making it possible to remove the blocking element 40 from the sealing device.

On its lower axial edge, said axial wall 41 comprises an annular radial wall 49 extending radially inwards. The radially internal edge of said annular radial wall 49 has a diameter less than the external diameter of the cylindrical axial sleeve 21 of the attachment ring 20. In the assembled state, this annular radial wall 49 is positioned axially under said cylindrical axial sleeve 21, thus preventing a removal of the blocking element 40 by axial traction upwards. The radially internal edge of the annular radial wall 49 also has a diameter less than the external diameter of the vessel 1.

In the assembled state of the sealing device, the stopper 10 seals with the collar 2 of the vessel 1, the attachment ring 20 attaches and holds said stopper 10 in its sealed sealing position, the cover 30 protects the stopper 10 and prevents access to its tapping zone 15, and the blocking element 40 prevents the removal of the cover 30 while being held in the blocking position, on the one hand, by snap-fitting with the cover 30, and on the other hand, by the axial blocking achieved by the attachment ring 20 at the annular radial wall 49. In the assembled state, the sealing device therefore forms a non-dismountable subassembly.

For the assembly of the sealing device, the attachment ring 20 is first assembled on the stopper 10, with advantageously, a snap-fitting of one on the other at the central opening 23. Then, in the example of FIG. 10, the cover 30 is assembled on the attachment ring 20 from above, and then the blocking element 40 is snap-fitted from below on the cover 30, according to the arrow F1. In a variant, the stopper—attachment ring unit can first be disposed in the blocking element 40, then the cover 30 snap-fitted from above. Optionally, the assembly of the cover 30 and of the blocking element 40 around the stopper—attachment ring unit can be done in one single step, the stopper—attachment ring unit thus being sandwiched between the cover 30 and the blocking element 40.

The assembly of the sealing device on the collar 2 of the vessel 1 is advantageously done by axial thrust downwards from the sealing device, according to the arrow F2 in FIG. 11. This simultaneously generates the insertion of the stopper 10 in the collar 2 of the vessel 1, and the attachment, in particular the snap-fitting, of the attachment ring 20 on said collar 2. The presence of the central recess 35 in the cover 30 guarantees that during assembly, all of the force F2 exerted on the cover 30 is transmitted to the attachment ring 20, without direct interaction between the cover 30 and the stopper 10.

The dimensions and shapes of said at least one sealing bead 13 are chosen, such that the sealing is guaranteed in the assembled state, without generating forces which are too large during assembly. This makes it possible to use an assembly machine with baskets or nests being able to simultaneously assemble several tens of devices, for example, around one hundred.

After assembly of the sealing device on the vessel, the sealing device comprises a tamper-proof first use indicator. Indeed, as the tearable tab 42 is not torn, and the blocking element 40 removed, the cover 30 cannot be removed. The content of the vessel is therefore fully protected. After removal of the blocking element 40, the cover 30 can also be removed. However, it is thus no longer possible to recover another blocking element 40, as this assembly must necessarily be done before assembly on the vessel 1. Indeed, the internal diameter of the annular radial wall 49 being less than the external diameter of the vessel 1, it is not possible to assemble a blocking element 40 above the vessel 1. Likewise, the internal diameter of the annular radial wall 49 being less than the external diameter of the cylindrical axial sleeve 21 of the attachment ring 20, it is not possible to assemble a blocking element 40 above the attachment ring 20.

Naturally, variants of embodiment can be considered, without deviating from the scope of the invention, such as defined by the accompanying claims.

The invention claimed is:

1. A device for sealing a fluid product vessel comprising a collar provided with an upper axial edge, said sealing device comprising:

a stopper comprising a radial plate and an axial drum, said axial drum penetrating inside said collar during assembly, said stopper comprising sealing means for sealing with said vessel, an attachment ring for attaching said stopper on said collar, said attachment ring comprising a cylindrical axial sleeve provided on the upper side with a radial flange extending radially inwards and comprising a central opening, said cylindrical axial sleeve comprising, on the lower side, first attachment means to be attached to said collar of said vessel, a cover comprising a radial disc and a cylindrical axial envelope extending axially downwards from said radial disc, said cover comprising second attachment means, a blocking element comprising a cylindrical axial wall and complementary attachment means engaging in the assembled state with said second attachment means of said cover, wherein said axial wall comprises, on one portion of its periphery, a tearable tab defined between two grooves forming bridges of thin material, said tearable tab comprising, on one side, a gripping portion and ending on the opposite side by a flared portion, such that once torn, said axial wall opens out along the entire height thereof, thus making it possible to remove said blocking element from said sealing device;

wherein said radial plate comprises a central tapping zone defined inside an axial ring; and wherein the radially external edge of said axial ring is conic by flaring upwards.

2. The device according to claim 1, wherein said axial drum of said stopper comprises on its outer surface, at least one sealing bead which engages with the inside of said collar of said vessel to guarantee the sealed sealing of said vessel.

3. The device according to claim 1, wherein said radial plate of said stopper has an external diameter greater than the external diameter of said axial drum, and comprises at least one annular projection extending downwards which, in the sealing position, engages with said upper axial edge of said collar.

4. The device according to claim 3, wherein said annular projection is peripheral and is, during the assembly of said sealing device on said collar of said vessel, flattened on said upper axial edge of said collar for sealing with said vessel.

5. A device for sealing a fluid product vessel comprising a collar provided with an upper axial edge, said sealing device comprising:

a stopper comprising a radial plate and an axial drum, said axial drum penetrating inside said collar during assembly, said stopper comprising sealing means for sealing with said vessel, an attachment ring for attaching said stopper on said collar, said attachment ring comprising a cylindrical axial sleeve provided on the upper side with a radial flange extending radially inwards and comprising a central opening, said cylindrical axial sleeve comprising, on the lower side, first attachment means to be attached to said collar of said vessel, a cover comprising a radial disc and a cylindrical axial envelope extending axially downwards from said radial disc, said cover comprising second attachment means, a blocking element comprising a cylindrical axial wall and complementary attachment means engaging in the assembled state with said second attachment means of said cover, wherein said axial wall comprises, on one portion of its periphery, a tearable tab defined between two grooves forming bridges of thin material, said tearable tab comprising, on one side, a gripping portion and ending on the opposite side by a flared portion, such that once torn, said axial wall opens out along the entire height thereof, thus making it possible to remove said blocking element from said sealing device;

wherein said radial plate comprises a central tapping zone defined inside an axial ring; and wherein, in the assembled state of said sealing device, said radial flange of said attachment ring is positioned on said radial plate of said stopper, said central opening receiving said axial ring and said tapping zone of said stopper.

6. The device according to claim 5, wherein the radial edge of said central opening is snap-fitted on said radially external conic edge of said axial ring.

7. The device according to claim 1, wherein said first attachment means of said attachment ring are snap-fitting means, comprising at least one radial profile extending radially inwards.

8. The device according to claim 7, wherein said first attachment means comprise one single radial profile which extends over the entire periphery of said cylindrical axial sleeve.

9. A device for sealing a fluid product vessel comprising a collar provided with an upper axial edge, said sealing device comprising:

a stopper comprising a radial plate and an axial drum, said axial drum penetrating inside said collar during assembly, said stopper comprising sealing means for sealing with said vessel, an attachment ring for attaching said stopper on said collar, said attachment ring comprising a cylindrical axial sleeve provided on the upper side with a radial flange extending radially inwards and comprising a central opening, said cylindrical axial sleeve comprising, on the lower side, first attachment means to be attached to said collar of said vessel, a cover comprising a radial disc and a cylindrical axial envelope extending axially downwards from said radial disc, said cover comprising second attachment means, a blocking element comprising a cylindrical axial wall and complementary attachment means engaging in the assembled state with said second attachment means of said cover, wherein said axial wall comprises, on one portion of its periphery, a tearable tab defined between two grooves forming bridges of thin material, said tearable tab comprising, on one side, a gripping portion and ending on the opposite side by a flared portion, such that once torn, said axial wall opens out along the entire height thereof, thus making it possible to remove said blocking element from said sealing device; and wherein the internal diameter of said cylindrical axial envelope of said cover is identical to or very slightly greater than the external diameter of said cylindrical axial sleeve of said attachment ring, such that in the assembled state of the sealing device, said cylindrical axial envelope is positioned around said cylindrical axial sleeve with no or little clearance between them.

10. The device according to claim 1, wherein said second attachment means of said cover comprise one or more projection(s) extending radially outwards.

11. The device according to claim 10, wherein said complementary attachment means of said blocking element comprise one or more profiles extending radially inwards, said profiles being snap-fitted on said one or more projection(s) forming said second attachment means of said cover.

12. The device according to claim 1, wherein said axial wall of said blocking element comprises, on its lower axial edge, an annular radial wall extending radially inwards, the radially internal edge of said annular radial wall having a diameter less than the external diameter of said cylindrical axial sleeve of said attachment ring, and less than the external diameter of said vessel.

13. The device according to claim 1, wherein said device has no metal.

14. An assembly comprising a fluid product vessel comprising a collar and a sealing device according to claim 1, to attach and hold a stopper on said collar.

* * * * *